US011105502B2

(12) United States Patent
Martin et al.

(10) Patent No.: US 11,105,502 B2
(45) Date of Patent: Aug. 31, 2021

(54) STAGED FUEL BURNER

(71) Applicant: Honeywell International Inc., Morristown, NJ (US)

(72) Inventors: Richard R. Martin, Tulsa, OK (US); Colin J. Deller, Tulsa, OK (US)

(73) Assignee: Honeywell International Inc., Charlotte, NC (US)

( * ) Notice: Subject to any disclaimer, the term of this patent is extended or adjusted under 35 U.S.C. 154(b) by 336 days.

(21) Appl. No.: 16/443,037

(22) Filed: Jun. 17, 2019

(65) Prior Publication Data

US 2020/0393124 A1 Dec. 17, 2020

(51) Int. Cl.

| | |
|---|---|
| ***F23C 6/04*** | (2006.01) |
| ***F23D 14/60*** | (2006.01) |
| ***F23D 14/22*** | (2006.01) |
| ***F23D 14/78*** | (2006.01) |
| ***F23D 14/64*** | (2006.01) |
| ***F23D 14/02*** | (2006.01) |

(52) U.S. Cl.
CPC ..... *F23C 6/047* (2013.01); *F23D 14/22* (2013.01); *F23D 14/60* (2013.01)

(58) Field of Classification Search
CPC ..... F23C 6/047; F23D 14/02; F23D 14/22; F23D 14/60; F23D 14/64; F23D 14/78; F23D 2900/00016
See application file for complete search history.

(56) References Cited

U.S. PATENT DOCUMENTS

| | | | | |
|---|---|---|---|---|
| 5,271,729 | A | 12/1993 | Gensler et al. | |
| 5,667,376 | A | 9/1997 | Robertson et al. | |
| 9,194,579 | B2 | 11/2015 | Martin et al. | |
| 2014/0102440 | A1* | 4/2014 | Martin | F23D 14/06 126/91 R |

OTHER PUBLICATIONS

International Search Report from corresponding PCT Application No. PCT/US2020/036753, dated Aug. 27, 2020.
Written Opinion from corresponding PCT Application No. PCT/US2020/036753, dated Aug. 20, 2020.

* cited by examiner

*Primary Examiner* — Jorge A Pereiro
*Assistant Examiner* — Logan P Jones

(57) ABSTRACT

A insert for a staged fuel burner and processes for using a burner with the insert. The insert has a burner tip that injects a mixture of primary fuel and combustion air into a combustion zone to produce a flame. A staged fuel is also injected into the combustion zone. Prior to being injected into the combustion zone, from the burner tip, the staged fuel, is injected into the burner tip and draws combustion air from the mixer of the burner insert into the burner tip with the staged fuel.

16 Claims, 5 Drawing Sheets

STAGED FUEL BURNER

FIELD OF THE INVENTION

This invention relates generally to a pre-mixed burner for a furnace in a refinery or chemical processing plant, and more particularly to an insert for such a burner that produces a flame by combusting a staged fuel.

BACKGROUND OF THE INVENTION

In refineries and chemical processing plant, furnaces are used to provide heat to process fluid within conduits inside of the furnace. Heat is produced in the furnace with radiant burners that have a tip which injects fuel/combustion air into the furnace to produce a flame at the burner tip. An example of such a burner is shown in U.S. Pat. No. 9,194,579, the entirety of which is incorporated herein.

In some conventional pre-mixed staged fuel burners, the staged fuel flows through a center pipe and discharges into the combustion zone (within the furnace) at the burner tip without pre-mixing with the combustion air. A primary fuel is mixed with combustion air within the burner venturi and is injected into the combustion zone also at the burner tip. The primary fuel is segregated within the burner from the staged fuel by the center pipe.

In many conventional designs, the burner tip, and specifically, the injection point of the staged fuel is within the furnace or otherwise located where it reaches a very high temperature because of the thermal radiation from the furnace. The flow of the staged fuel through the center pipe is insufficient to cool or otherwise reduce the temperature at the point of injection. Accordingly, the high temperature at the point of injection may form coke deposits. The coke plugs the ports in the staged fuel tip which is undesired and negatively affects the effectiveness of the burner tip.

Accordingly, it would be desirable to provide a burner tip that provides the benefits of using a staged fuel injection, but which does not suffer from these drawbacks found in some conventionally used designs.

SUMMARY OF THE INVENTION

A new premix insert for a burner, and various processes associated with same, have been invented. According to the various embodiments, combustion air is mixed with the staged fuel in the burner before the staged fuel is injected into the furnace. The addition of the combustion air cools the staged fuel discharge ports which reduces or eliminates the possibility of coke formation and fouling by coke deposits.

According to various aspects, the staged fuel outlet from the center pipe is located inside of the burner venturi/mixer to prevent over heating the discharge ports for the staged fuel. This also allows for the staged fuel gas to mix with the combustion air before flowing through the burner tip into the furnace. This mixture is less likely to form coke because of the lower temperature. Additionally, the mixture of staged fuel and combustion air provides a higher mass flow rate that will reduce the maximum temperature that the staged fuel reaches before it is discharged into the furnace. The mixture of staged fuel and combustion air also reduces the temperature of the metal components of the burner that contacts the staged fuel.

Therefore, the present invention may be characterized, in at least one aspect, as providing an insert for a staged fuel burner. The insert includes a mixer having an internal volume, a burner tip with a body having an inner surface facing the internal volume of the mixer and an outer surface opposite the inner surface and including a first plurality of exhaust ports in communication with the internal volume of the mixer, and, a conduit within the mixer extending towards the burner tip, the conduit terminating at a first end with an outlet spaced from the burner tip so as to draw gas from the mixer to mix with fuel passing into the burner tip from the outlet.

It is contemplated that the conduit includes at least one injection port spaced from the outlet and configured to provide fuel from the conduit to the internal volume of the mixer.

It is contemplated that the insert further includes a second plurality of exhaust ports configured to receive fuel from the conduit. The exhaust ports from the second plurality may be disposed on an uppermost portion of the outer surface of the burner tip. The exhaust ports from the first plurality may be disposed on an outer side wall of the outer surface of the burner tip.

It is contemplated that the burner tip includes an inlet configured to receive fuel from the outlet of the conduit. The inlet of the burner tip may be in communication with a second plurality of exhaust ports disposed on the outer surface of the burner tip. The inlet of the burner tip may include a guide wall extending away from the body of the burner tip into the mixer. The outlet of the conduit may be disposed within the body of the burner tip.

In a second aspect, the present invention may be generally characterized as providing a process for cooling a fuel conduit of a burner by: injecting a fuel into a mixer of the burner; mixing the fuel with a combustion air within the mixer to provide a primary fuel/air mixture; passing the primary fuel/air mixture through a first plurality of exhaust ports on a burner tip into a furnace containing the process fluid; combusting the primary fuel/air mixture in the furnace to produce a flame at the burner tip; passing a staged fuel through the mixer to the burner tip while the staged fuel is separated from the primary fuel/air mixture within the mixer via a conduit; discharging the staged fuel from an end of the conduit into the burner tip; passing the staged fuel through a second plurality of exhaust ports on the burner tip; combusting the staged fuel in the furnace to produce the flame; and, cooling the end of the conduit by drawing gas from the mixer into the burner tip with the staged fuel.

The conduit may include at least one injection port for injecting the fuel into the mixer.

The exhaust ports from the second plurality may be disposed on an uppermost portion of the outer surface of the burner tip. The exhaust ports from the first plurality may be disposed on an outer side wall of the outer surface of the burner tip.

The end of the conduit may include an outlet located within a body of the burner tip. The body of the burner tip may include an inlet for the conduit and the inlet may include at least one guide wall.

In yet a third aspect, the present invention may broadly be characterized as providing a process for heating a process fluid with a burner by: injecting a primary fuel into a mixer of the burner; mixing the primary fuel with a combustion air within the mixer to provide a primary fuel/air mixture; passing the primary fuel/air mixture through a first plurality of exhaust ports on a burner tip into a furnace containing the process fluid; combusting the primary fuel/air mixture in the furnace to produce a flame at the burner tip, the flame providing heat for the process fluid; passing a staged fuel through the mixer to the burner tip while the staged fuel is separated from the primary fuel/air mixture within the mixer in a conduit; discharging the staged fuel from the conduit and towards the burner tip so as to draw gas from the mixer to mix with the staged fuel to provide a staged fuel/air mixture; passing the staged fuel/air mixture through a second plurality of exhaust ports on the burner tip into the furnace; and combusting the staged fuel to produce the flame.

The conduit may include an end with an outlet, and the staged fuel may be discharged from the conduit through the outlet. The burner tip may include an inlet configured to receive the staged fuel discharged from the outlet. The inlet may include a guide wall.

The exhaust ports from the second plurality may be disposed on an uppermost portion of the outer surface of the burner tip, and the exhaust ports from the first plurality may be disposed on an outer side wall of the outer surface of the burner tip.

Additional aspects, embodiments, and details of the invention, all of which may be combinable in any manner, are set forth in the following detailed description of the invention.

DETAILED DESCRIPTION OF THE DRAWINGS

One or more exemplary embodiments of the present invention will be described below in conjunction with the following drawing figures, in which.

Figure 1:
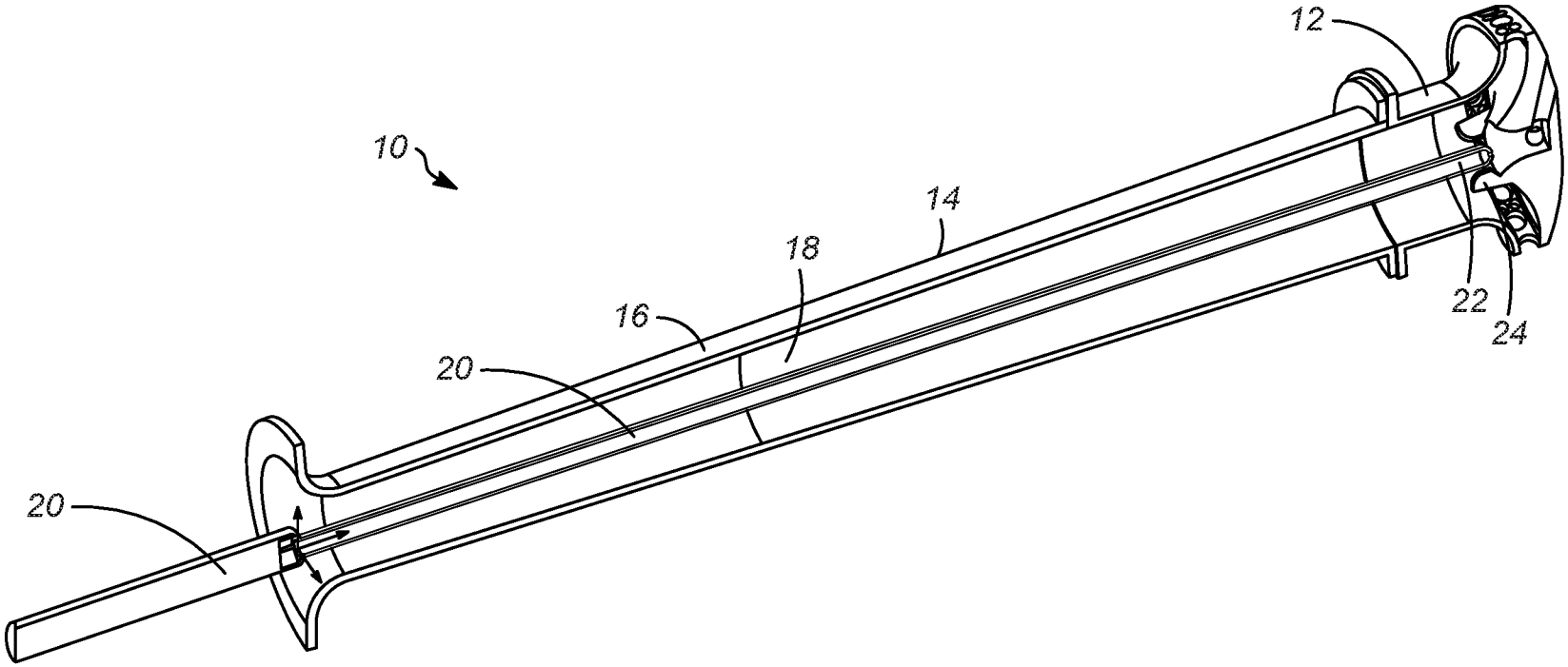
FIG. 1 shows a cutaway, side perspective view of a burner according to aspects of the present invention.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION OF THE INVENTION

As mentioned above, a new staged fuel burner has been invented. According to various embodiments, the staged fuel is mixed with combustion air prior to being injected to into the furnace. With these general principles in mind, one or more embodiments of the present invention will be described with the understanding that the following description is not intended to be limiting.

With reference to FIG. 1, the present invention relates to a pre-mix insert 10 for a burner that is typically located in a burner tile or furnace wall. Such burners are known and are particularly suited for cracking and reforming furnaces although other furnaces are possible within the spirit and scope of the invention. For an example of a furnace with tubes having process fluid, reference is made to U.S. Pat. Pub. No. 2017/0003017, the entirety of which his incorporated herein by reference.

The pre-mix insert 10 includes a burner tip 12 and a mixer 14. The mixer 14 has a body 16 that has an internal volume 18. Extending through the internal volume 18 of the mixer is a conduit 20. The conduit 20 has a first end 22 that terminates with an outlet 24 (also known as the staged fuel tip) at the burner tip 12 (discussed in more detail below).

Figure 2:
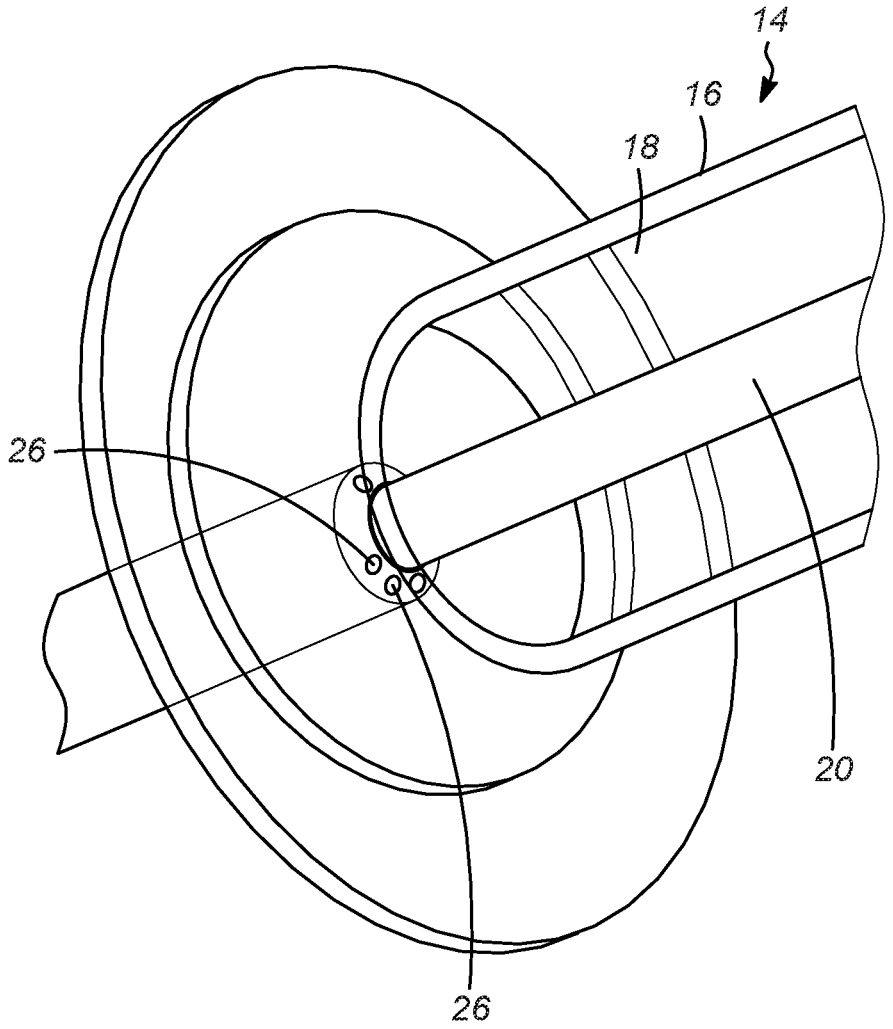
FIG. 2 shows a closeup perspective view of a portion of the burner in FIG. 1.

As shown best in FIG. 2, spaced from the outlet 24 on the conduit 20 are one or more injection ports 26. The injection ports 26 inject primary fuel from the conduit 20 into the internal volume 18 of the mixer 14 to form a primary fuel/combustion air mixture with air in mixer 14.

Returning to FIG. 1, the mixture of primary fuel/combustion air travels through the mixer 14 towards the burner tip 12. At the same time, the remaining fuel within the conduit 20, the staged fuel, also travels through the conduit 20 towards the burner tip 12.

Figure 3:
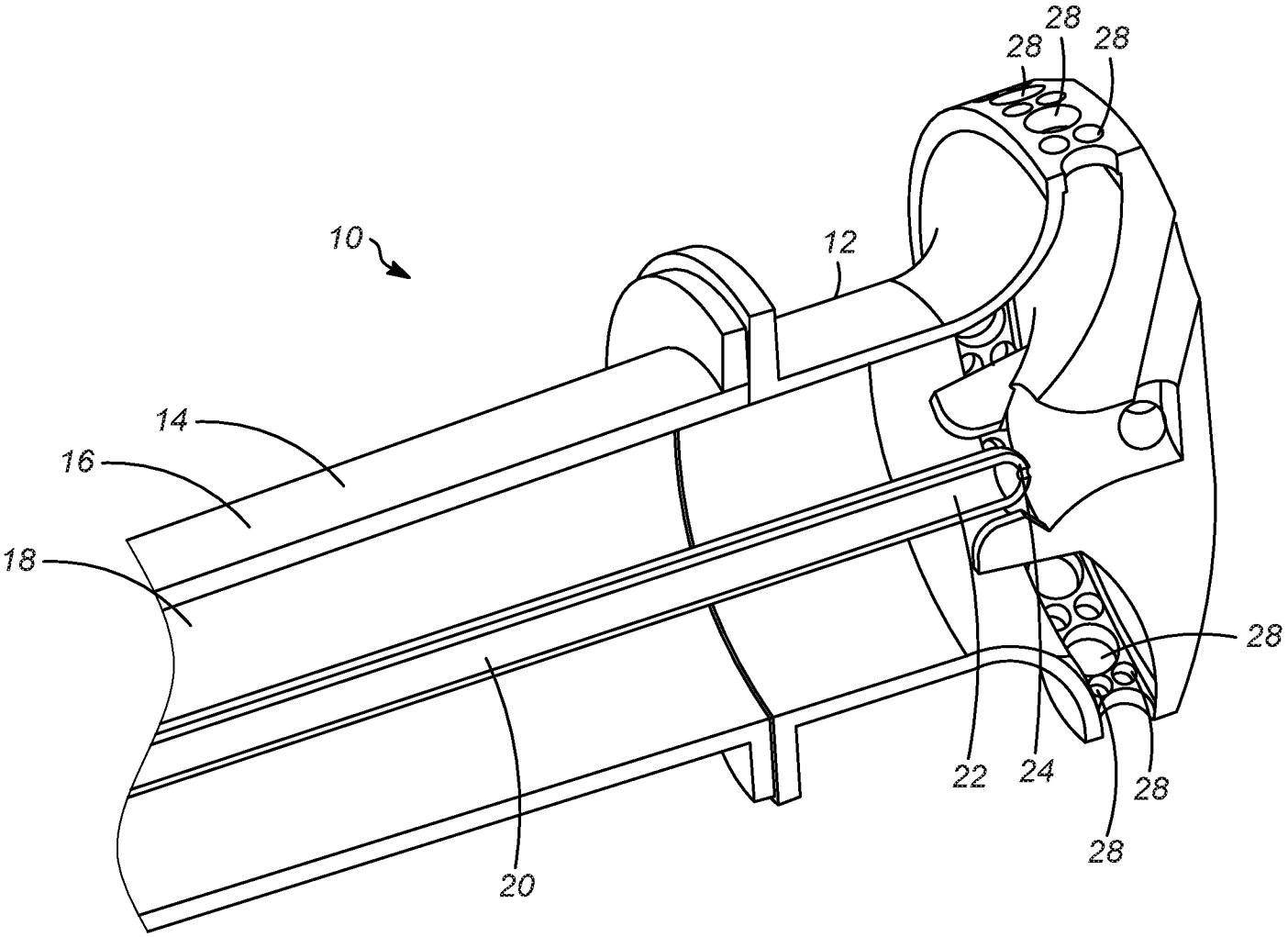
FIG. 3 shows another closeup perspective view of a portion of the burner in FIG. 1.

Turning to FIG. 3, the burner tip 12 includes a plurality of first exhaust ports 28 which are in communication with the internal volume 18 of the mixer 14. The mixture of primary fuel/combustion air exits the burner, at the burner tip 12, via the first exhaust ports 28. Upon exiting the burner tip 12 the mixture of primary fuel/combustion air combusts in the furnace to form a flame. As discussed above, the flame produces heat which is transferred to process fluids within various conduits within the furnace.

The staged fuel exits the conduit 20 at the outlet 24 and enters the burner tip 12. The outlet 24 is spaced from the burner tip 12 so that the staged fuel draws combustion air from the mixer 14 to mix with the staged fuel as it is passed into the burner tip 12. It should be understood that the combustion air mixed with the staged fuel will also include some primary fuel. As discussed above, by mixing the staged fuel with some combustion air, a better flame is produced, the outlet 24 is cooled by the flow of gases, and is therefore less likely to overheat and form coke, plugging or otherwise damaging the burner.

Figure 4:
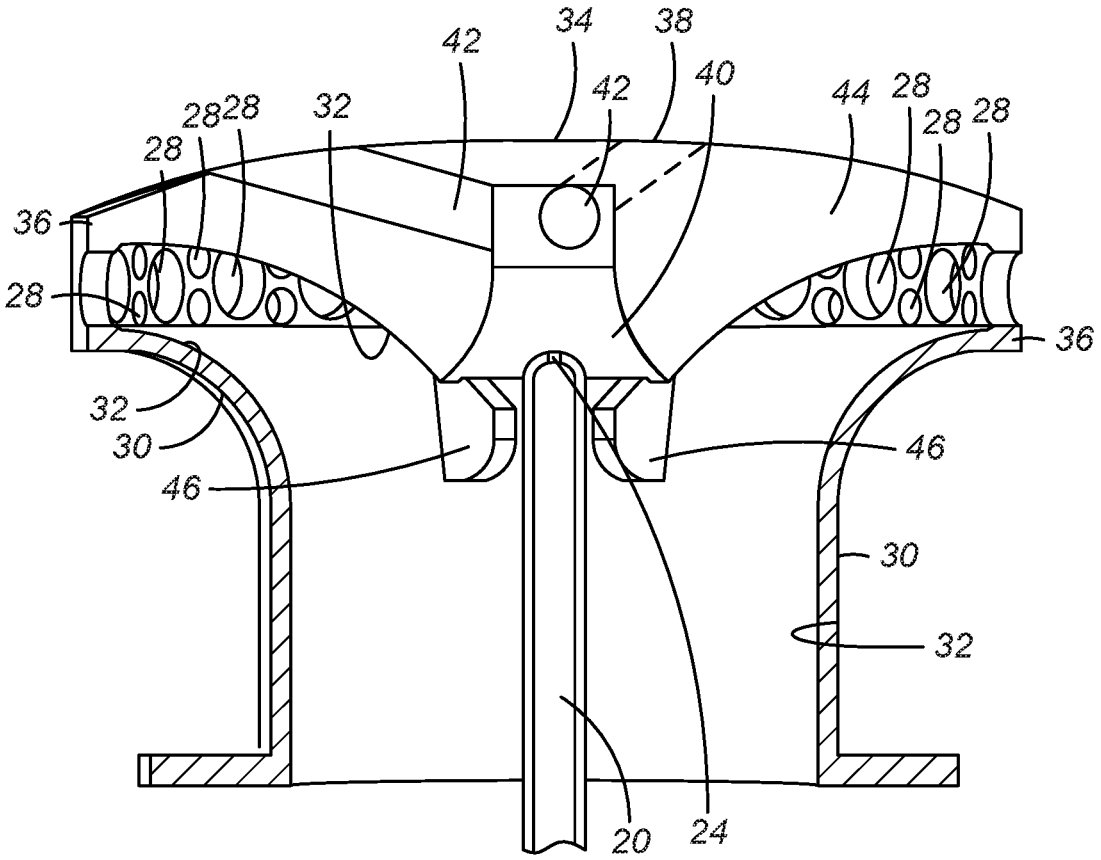
FIG. 4 shows a side cutaway view of the burner tip from the burner of FIG. 1; and, FIG. 5 shows a top and side perspective view of the burner tip of FIG. 4.

Turning to FIG. 4, an outer surface 30 and an inner surface 32 of the burner tip 12 is shown. The inner surface 32 faces the internal volume 18 of the mixer 14 (FIGS. 1 and 3). The outer surface 30 is opposite the inner surface 32 and is located all, or partially, in the furnace.

Figure 5:
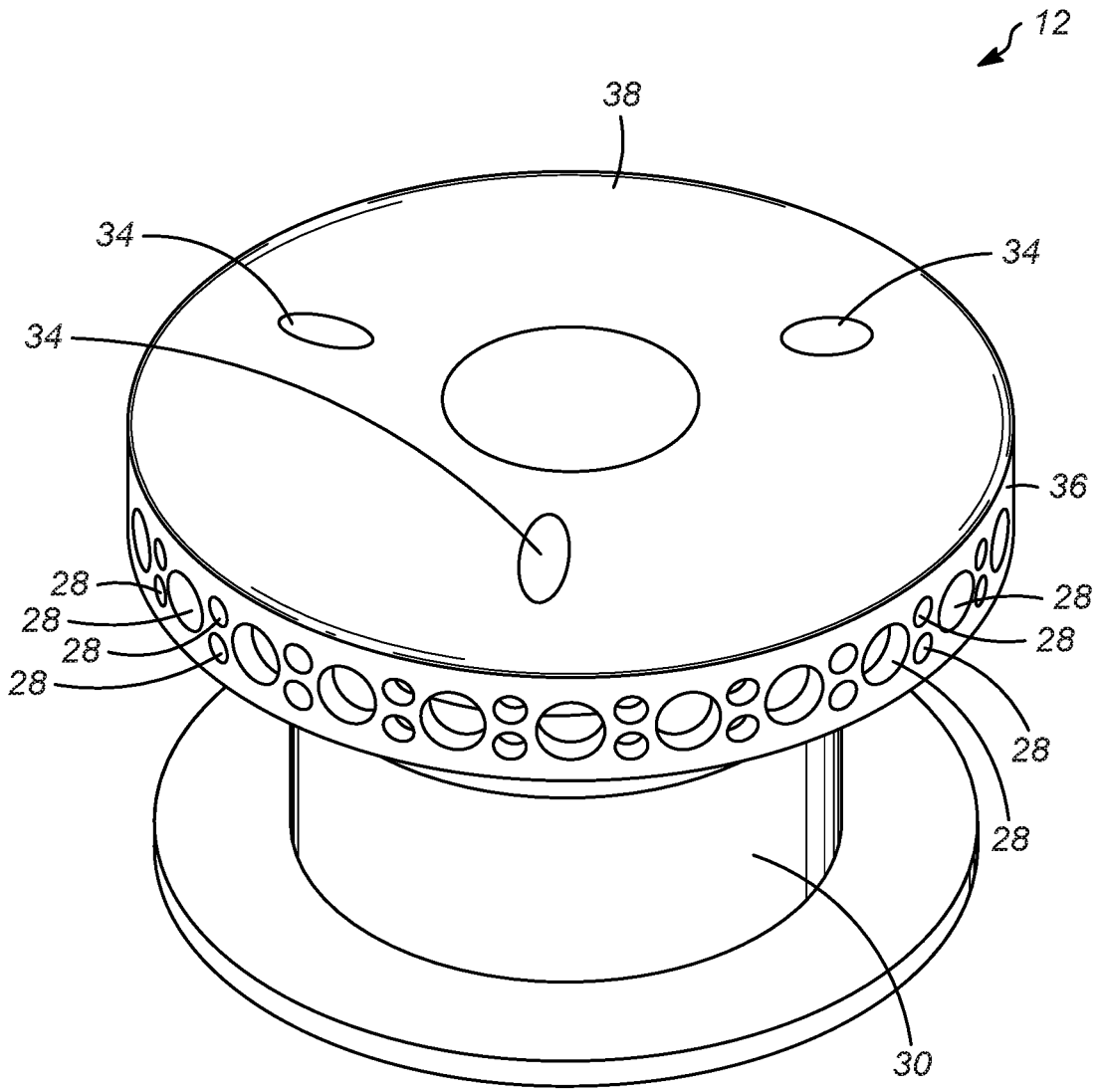

As shown in FIGS. 4 and 5, the outer surface 30 of the burner tip 12 also includes a plurality of second exhaust ports 34 for injecting the staged fuel mixed with combustion air into the furnace to produce the flame. The plurality of exhaust ports 28 (for the primary fuel/combustion air mixture) are preferably located on a side wall 36 of the burner tip 12. The side wall 36 has a height in a direction parallel to a longitudinal axis of the pre-mix insert 10 and a thickness through which the first exhaust ports 28 extend. The plurality of second exhaust ports 34 (for the staged fuel) are preferably located on an uppermost portion 38, or top, of the outer surface 30 of the burner tip 12. The term "uppermost" refers to the orientation shown in the drawings, as it would be appreciated that the burners are not always used in a configuration or orientation shown in FIG. 4.

As shown in FIG. 4, the burner tip 12 includes an inlet 40 on the inner surface 32 to receive the fuel from the outlet 24 of the conduit 20. The inlet 40 is in communication with the plurality of exhaust ports 34 via flow channels 42 within the burner tip 12.

In the depicted embodiment, the conduit 20 extends at least to the inlet 40, but not to the upper most portion 38 of the outer surface 30. The conduit 20 may partially extend into a body 44 of the burner tip 12 so that the outlet 24 is located within the body 44 of the burner tip 12. However, it is also contemplated that the outlet 24 is located slightly below the inlet 40. As discussed above, as the staged fuel exits the outlet 24, combustion air from the internal volume 18 (FIGS. 1 and 3) of the mixer 14 will be drawn into the inlet 40, mix with the staged fuel, pass through the channels 42, and be injected into the furnace via the second exhaust ports 34. Accordingly, the conduit 20 and the body 44 of the burner tip 12 are spaced apart and do not touch. However, other configurations and arrangements may be used so that air from the mixer 14 is drawn up into the burner tip 12 to be mixed with the staged fuel. For example, although not shown, the ports should be included on the inner surface 32 to draw combustion air into a plenum within the body 44 which also receives the staged fuel.

In FIG. 4, the inlet 40 includes one or more guide walls 46 extending away from the inner surface 32 towards the mixer 14 (FIGS. 1 and 3). The main purpose of the guide walls 46 are to center the ensure that the conduit 20, and more specifically, the first end 22 is positioned properly, which is usually centered with respect to the body 44 of the burner tip 12. In addition, depending on the shape and size, the guide walls 46 may also control or direct the flow of air, as well as fuel, into the inlet 40.

Accordingly, by utilizing the present premix insert 10 in a burner, the benefits of using a staged fuel burner are achieved while the risks of creating coke from overheating at the tip of the burner are reduced.

It should be appreciated and understood by those of ordinary skill in the art that various other components such as valves, pumps, filters, coolers, etc. were not shown in the drawings as it is believed that the specifics of same are well within the knowledge of those of ordinary skill in the art and a description of same is not necessary for practicing or understanding the embodiments of the present invention.

Any of the above lines, conduits, units, devices, vessels, surrounding environments, zones or similar may be equipped with one or more monitoring components including sensors, measurement devices, data capture devices or data transmission devices. Signals, process or status measurements, and data from monitoring components may be used to monitor conditions in, around, and on process equipment. Signals, measurements, and/or data generated or recorded by monitoring components may be collected, processed, and/or transmitted through one or more networks or connections that may be private or public, general or specific, direct or indirect, wired or wireless, encrypted or not encrypted, and/or combination(s) thereof; the specification is not intended to be limiting in this respect.

Signals, measurements, and/or data generated or recorded by monitoring components may be transmitted to one or more computing devices or systems. Computing devices or systems may include at least one processor and memory storing computer-readable instructions that, when executed by the at least one processor, cause the one or more computing devices to perform a process that may include one or more steps. For example, the one or more computing devices may be configured to receive, from one or more monitoring component, data related to at least one piece of equipment associated with the process. The one or more computing devices or systems may be configured to analyze the data. Based on analyzing the data, the one or more computing devices or systems may be configured to determine one or more recommended adjustments to one or more parameters of one or more processes described herein. The one or more computing devices or systems may be configured to transmit encrypted or unencrypted data that includes the one or more recommended adjustments to the one or more parameters of the one or more processes described herein.

SPECIFIC EMBODIMENTS

While the following is described in conjunction with specific embodiments, it will be understood that this description is intended to illustrate and not limit the scope of the preceding description and the appended claims.

A first embodiment of the invention is an insert for a staged fuel burner, the insert comprising a mixer having an internal volume; a burner tip comprising a body having an inner surface facing the internal volume of the mixer and an outer surface opposite the inner surface, the outer surface of the burner tip comprising a first plurality of exhaust ports, wherein the exhaust ports from the first plurality are in communication with the internal volume of the mixer; and, a conduit within the mixer extending towards the burner tip, the conduit terminating at a first end with an outlet, the outlet is spaced from the burner tip so as to draw gas from the mixer to mix with fuel passing into the burner tip from the outlet. An embodiment of the invention is one, any or all of prior embodiments in this paragraph up through the first embodiment in this paragraph, wherein the conduit comprises at least one injection port spaced from the outlet and configured to provide fuel from the conduit to the internal volume of the mixer. An embodiment of the invention is one, any or all of prior embodiments in this paragraph up through the first embodiment in this paragraph, further comprising a second plurality of exhaust ports configured to receive fuel from the conduit. An embodiment of the invention is one, any or all of prior embodiments in this paragraph up through the first embodiment in this paragraph, wherein the exhaust ports from the second plurality are disposed on an uppermost portion of the outer surface of the burner tip. An embodiment of the invention is one, any or all of prior embodiments in this paragraph up through the first embodiment in this paragraph, wherein the exhaust ports from the first plurality are disposed on an outer side wall of the outer surface of the burner tip. An embodiment of the invention is one, any or all of prior embodiments in this paragraph up through the first embodiment in this paragraph, wherein the burner tip comprises an inlet configured to receive fuel from the outlet of the conduit. An embodiment of the invention is one, any or all of prior embodiments in this paragraph up through the first embodiment in this paragraph, wherein the inlet of the burner tip is in communication with a second plurality of exhaust ports disposed on the outer surface of the burner tip. An embodiment of the invention is one, any or all of prior embodiments in this paragraph up through the first embodiment in this paragraph, wherein the inlet of the burner tip includes a guide wall extending away from the body of the burner tip into the mixer. An embodiment of the invention is one, any or all of prior embodiments in this paragraph up through the first embodiment in this paragraph, wherein the outlet of the conduit is disposed within the body of the burner tip.

A second embodiment of the invention is a process for cooling a fuel conduit of a burner, the process comprising injecting a fuel into a mixer of the burner; mixing the fuel with a combustion air within the mixer to provide a primary fuel/air mixture; passing the primary fuel/air mixture through a first plurality of exhaust ports on a burner tip into a furnace containing the process fluid; combusting the primary fuel/air mixture in the furnace to produce a flame at the burner tip; passing a staged fuel through the mixer to the burner tip while the staged fuel is separated from the primary fuel/air mixture within the mixer via a conduit; discharging the staged fuel from an end of the conduit into the burner tip; passing the staged fuel through a second plurality of exhaust ports on the burner tip; combusting the staged fuel in the furnace to produce the flame; and, cooling the end of the conduit by drawing gas from the mixer into the burner tip with the staged fuel. An embodiment of the invention is one, any or all of prior embodiments in this paragraph up through the second embodiment in this paragraph, wherein the conduit comprises at least one injection port for injecting the fuel into the mixer. An embodiment of the invention is one, any or all of prior embodiments in this paragraph up through the second embodiment in this paragraph, wherein the exhaust ports from the second plurality are disposed on an uppermost portion of the outer surface of the burner tip. An embodiment of the invention is one, any or all of prior embodiments in this paragraph up through the second embodiment in this paragraph, wherein the exhaust ports from the first plurality are disposed on an outer side wall of the outer surface of the burner tip. An embodiment of the invention is one, any or all of prior embodiments in this paragraph up through the second embodiment in this paragraph, wherein the end of the conduit comprises an outlet located within a body of the burner tip. An embodiment of the invention is one, any or all of prior embodiments in this paragraph up through the second embodiment in this paragraph, wherein the body of the burner tip comprises an inlet for the conduit and wherein the inlet comprises at least one guide wall.

A third embodiment of the invention is a process for heating a process fluid with a burner, the process comprising injecting a primary fuel into a mixer of the burner; mixing the primary fuel with a combustion air within the mixer to provide a primary fuel/air mixture; passing the primary fuel/air mixture through a first plurality of exhaust ports on a burner tip into a furnace containing the process fluid; combusting the primary fuel/air mixture in the furnace to produce a flame at the burner tip, the flame providing heat for the process fluid; passing a staged fuel through the mixer to the burner tip while the staged fuel is separated from the primary fuel/air mixture within the mixer in a conduit; discharging the staged fuel from the conduit and towards the burner tip so as to draw gas from the mixer to mix with the staged fuel to provide a staged fuel/air mixture; passing the staged fuel/air mixture through a second plurality of exhaust ports on the burner tip into the furnace; and combusting the staged fuel to produce the flame. An embodiment of the invention is one, any or all of prior embodiments in this paragraph up through the third embodiment in this paragraph, wherein the conduit comprises an end with an outlet, wherein the staged fuel is discharged from the conduit through the outlet. An embodiment of the invention is one, any or all of prior embodiments in this paragraph up through the third embodiment in this paragraph, wherein the burner tip comprises an inlet configured to receive the staged fuel discharged from the outlet. An embodiment of the invention is one, any or all of prior embodiments in this paragraph up through the third embodiment in this paragraph, wherein the inlet comprises a guide wall. An embodiment of the invention is one, any or all of prior embodiments in this paragraph up through the third embodiment in this paragraph, wherein the exhaust ports from the second plurality are disposed on an uppermost portion of the outer surface of the burner tip, and wherein the exhaust ports from the first plurality are disposed on an outer side wall of the outer surface of the burner tip.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. An insert for a staged fuel burner, the insert comprising:

a mixer having an internal volume;

a burner tip comprising a body having an inner surface facing the internal volume of the mixer and an outer surface opposite the inner surface, the outer surface of the burner tip comprising a first plurality of exhaust ports, wherein the exhaust ports from the first plurality are in communication with the internal volume of the mixer;

a conduit within the mixer extending towards the burner tip, the conduit terminating at a first end with an outlet, the outlet is spaced from the burner tip so as to draw gas from the mixer to mix with fuel passing into the burner tip from the outlet;

a second plurality of exhaust ports configured to receive the fuel from the conduit; and wherein the exhaust ports from the second plurality are disposed on an uppermost portion of the outer surface of the burner tip.

2. The insert of claim 1, wherein the conduit comprises at least one injection port spaced from the outlet and configured to provide a fuel from the conduit to the internal volume of the mixer.

3. The insert of claim 1, wherein the exhaust ports from the first plurality are disposed on an outer side wall of the outer surface of the burner tip.

4. The insert of claim 1, wherein the burner tip comprises an inlet configured to receive a fuel from the outlet of the conduit.

5. The insert of claim 4, wherein the inlet of the burner tip is in communication with a second plurality of exhaust ports disposed on the outer surface of the burner tip.

6. The insert of claim 5, wherein the inlet of the burner tip includes a guide wall extending away from the body of the burner tip into the mixer.

7. The insert of claim 6, wherein the outlet of the conduit is disposed within the body of the burner tip.

8. A process for cooling a fuel conduit of a burner, the process comprising:

injecting a fuel into a mixer of the burner;

mixing the fuel with a combustion air within the mixer to provide a primary fuel/air mixture;

passing the primary fuel/air mixture through a first plurality of exhaust ports on a burner tip into a furnace containing a process fluid;

combusting the primary fuel/air mixture in the furnace to produce a flame at the burner tip;

passing a staged fuel through the mixer to the burner tip while the staged fuel is separated from the primary fuel/air mixture within the mixer via a conduit;

discharging the staged fuel from an end of the conduit into the burner tip;

passing the staged fuel through a second plurality of exhaust ports on the burner tip, wherein the exhaust ports from the second plurality are disposed on an uppermost portion of an outer surface of the burner tip;

combusting the staged fuel in the furnace to produce the flame; and cooling the end of the conduit by drawing gas from the mixer into the burner tip with the staged fuel.

9. The process of claim 8, wherein the conduit comprises at least one injection port for injecting the fuel into the mixer.

10. The process of claim 8, wherein the exhaust ports from the first plurality are disposed on an outer side wall of the outer surface of the burner tip.

11. The process of claim 8, wherein the end of the conduit comprises an outlet located within a body of the burner tip.

12. The process of claim 11, wherein the body of the burner tip comprises an inlet for the conduit and wherein the inlet comprises at least one guide wall.

13. A process for heating a process fluid with a burner, the process comprising:

injecting a primary fuel into a mixer of the burner;

mixing the primary fuel with a combustion air within the mixer to provide a primary fuel/air mixture;

passing the primary fuel/air mixture through a first plurality of exhaust ports on a burner tip into a furnace containing the process fluid;

combusting the primary fuel/air mixture in the furnace to produce a flame at the burner tip, the flame providing heat for the process fluid;

passing a staged fuel through the mixer to the burner tip while the staged fuel is separated from the primary fuel/air mixture within the mixer in a conduit;

discharging the staged fuel from the conduit and towards the burner tip so as to draw gas from the mixer to mix with the staged fuel to provide a staged fuel/air mixture;

passing the staged fuel/air mixture through a second plurality of exhaust ports on the burner tip into the furnace, wherein the exhaust ports from the second plurality are disposed on an uppermost portion of an outer surface of the burner tip, and wherein the exhaust ports from the first plurality are disposed on an outer side wall of the outer surface of the burner tip; and combusting the staged fuel to produce the flame.

14. The process of claim 13, wherein the conduit comprises an end with an outlet, wherein the staged fuel is discharged from the conduit through the outlet.

15. The process of claim 14, wherein the burner tip comprises an inlet configured to receive the staged fuel discharged from the outlet.

16. The process of claim 15, wherein the inlet comprises a guide wall.

* * * * *